US005081470A

United States Patent [19]

Kurabayashi et al.

[11] Patent Number: 5,081,470

[45] Date of Patent: Jan. 14, 1992

[54] RECORDING MEDIUM AND PROCESS FOR RECORDING USING THE SAME

[75] Inventors: Yutaka Kurabayashi, Yokohama; Mamoru Sakaki, Sagamihara; Hiroshi Sato, Yokohama, all of Japan

[73] Assignee: Canon Kabushiki Kaisha, Tokyo, Japan

[21] Appl. No.: 542,709

[22] Filed: Jun. 25, 1990

[30] Foreign Application Priority Data

Jun. 26, 1989 [JP] Japan ..... 1-165044

[51] Int. Cl.[5] ..... B41M 5/00

[52] U.S. Cl. ..... 346/1.1; 346/135.1; 428/195; 428/330; 428/341

[58] Field of Search ..... 346/1.1, 135.1; 428/195, 206, 323, 330, 341

[56] References Cited

U.S. PATENT DOCUMENTS

| | | | |
|---|---|---|---|
| 4,636,805 | 1/1987 | Toganoh et al. | 346/1.1 |
| 4,686,118 | 8/1987 | Arai et al. | 428/195 |
| 4,758,461 | 7/1988 | Akiya et al. | 428/195 |
| 4,770,934 | 9/1988 | Yamasaki et al. | 428/331 |
| 4,877,680 | 10/1989 | Sakaki et al. | 428/195 |
| 4,956,223 | 9/1990 | Arai et al. | 428/195 |
| 4,965,612 | 10/1990 | Sakaki et al. | 346/1.1 |

FOREIGN PATENT DOCUMENTS

| | | | |
|---|---|---|---|
| 56-148585 | 11/1981 | Japan | 428/195 |
| 59-185690 | 10/1984 | Japan | 428/195 |
| 60-49990 | 3/1985 | Japan | 428/195 |
| 61-57380 | 3/1986 | Japan | 428/195 |
| 057380 | 3/1986 | Japan | 428/195 |

OTHER PUBLICATIONS

An article entitled, "Testing Method for Ash in Paper and Paperboard", Japanese Industrial Standard (1980), pp. 1–3.

*Primary Examiner*—Pamela R. Schwartz

*Attorney, Agent, or Firm*—Fitzpatrick, Cella, Harper & Scinto

[57] ABSTRACT

A recording medium which comprises a support and an ink receiving layer containing pigments provided on the support, the pigment having a BET specific surface area of 30 to 120 $m^2/g$ and an iodine adsorbability per unit surface area of 1.5 $mg/m^2$ or more as the main pigment component.

39 Claims, No Drawings

RECORDING MEDIUM AND PROCESS FOR RECORDING USING THE SAME

BACKGROUND OF THE INVENTION

1. Field of the Invention

This invention relates to a recording medium suitable for an ink jet recording process and particularly to a recording medium with a distinguished absorbability of aqueous ink and a good coloring property, capable of producing a considerably clear recorded image.

The present invention relates furthermore to a recording medium with less indoor discoloration of images, etc., capable of producing recorded images with a good preservation.

2. Related Background Art

Heretofore well-known recording mediums for the ink jet recording process include (1) plain paper composed mainly of pulps, processed into filter paper or blotting paper with a low sizing degree by a paper-making process, (2) high quality paper, etc. with less ink absorbability, provided with an ink-absorbing layer composed of porous inorganic pigments thereon, as disclosed in Japanese Patent Application Laid-open No. 56-148585, etc.

The ink jet recording system for forming a color image with a high grade and a high resolution requires particularly a better image preservability. In this connection, processes for retarding image color fading due to irradiation with sunlight, visible light, ultraviolet light, etc. are known {e.g. Japanese Patent Application Laid-open No. 60-49990, No. 61-57380 and etc.}.

Recently, a problem of indoor discoloration of recorded images has been newly addressed as a problem peculiar to coated paper. The problem of light resistance so far addressed has been a problem of image fading by irradiation with ultraviolet light or visible light, that is, a problem to be encountered on the images printed on any paper including ordinary PPC paper, i.e., high-quality paper, as well as coated paper for ink jet printing. The problem of image indoor discoloration as mentioned above is a problem of discoloration of images formed on coated paper preserved at locations without direct exposure to sunlight, and is not encountered on the images printed on non-coated paper such as PPC paper, etc. That is, the problem of image indoor discoloration is another problem than that of light resistance. Thus, the problem of image indoor discoloration is peculiar to coated paper and thus seems to be due to pigments that constitute the coating layer. It is known that image indoor discoloration is connected to the specific surface area of the pigments used, and image indoor discoloration can be suppressed with ordinary fillers of small specific area such as calcium carbonate, kaolin, talc, etc. However, the optical density is low when such a filler is used, and images with a high quality and high resolution are hard to obtain. In other words, images with a high optical density can be obtained on coated paper using silica of large specific surface area and high activity, as disclosed, for example, in Japanese Patent Application Laid-open No. 56-185690, whereas the problem of image indoor discoloration becomes remarkable. As explained above, the suppression of image indoor discoloration and the increase in optical density are inconsistent with each other, and the inconsistency has not been solved so far.

SUMMARY OF THE INVENTION

An object of the present invention is to provide a recording medium with a good recorded image preservability, particularly less image deterioration due to indoor discoloration, and a high optical density, and also to provide a process for recording using the same.

The object of the present invention can be attained according to the following aspects of the present invention.

An aspect of the present invention is a recording medium which comprises a support and an ink receiving layer containing a pigment provided on the support, the pigment having a BET specific surface area 30 to 120 $m^2/g$ and an iodine adsorbability per unit surface area of 1.5 $mg/m^2$ or more as the main pigment component.

An another aspect of the present invention is a recording medium, which comprises a liquid-absorbable base sheet and an ink receiving layer containing a pigment provided on the surface of the liquid-absorbable sheet, the pigment having a BET specific surface area of 30 to 120 $m^2/g$ and an iodine adsorbability per unit surface area of 1.5 $mg/m^2$ or more as the main pigment, component and Stöckigt sizing degree throughout the recording medium being in a range of 0 to 15 seconds.

A further aspect of the present invention is a recording medium, which comprises a support and an ink receiving layer containing a pigment provided on the support, the pigment comprising a pigment (A) having a BET specific surface area of 30 to 120 $m^2/g$ and an iodine adsorbability per unit surface area of 1.5 $mg/m^2$ or more as the main pigment component and another pigment (B).

A still further aspect of the present invention is a recording medium, which comprises a liquid-absorbable sheet and an ink receiving layer provided on the surface of the liquid-absorbable sheet, the pigment comprising a pigment (A) having a BET specific surface area of 30 to 120 $m^2/g$ and an iodine adsorbability per unit surface area of 1.5 $mg/m^2$ or more as the main pigment component and another pigment (B), Stöckigt sizing degree throughout the recording medium being in a range of 0 to 15 seconds.

A further another aspect of the present invention is a process for recording which comprises imparting liquid droplets of a recording solution containing a water-soluble dye to a recording medium, thereby conducting recording, the recording medium comprising an ink receiving layer containing a pigment, the pigment having a BET specific surface area of 30 to 120 $m^2/g$ and an iodine adsorbability per unit surface are of 1.5 $mg/m^2$ or more as the main pigment component.

DETAILED DESCRIPTION OF THE PREFERRED EMBODIMENTS

The present invention will be described in detail below, referring to preferred embodiments.

The main pigment component for the present ink receiving layer is characterized in that a distinguished dye adsorbability and a high optical density can be obtained in spite of a smaller BET specific surface area than that of pigments used in the ordinary ink jet recording media.

The iodine adsorbability per unit surface area referred to herein is a value given by dividing the weight of iodine adsorbed on unit weight of pigments determined from the weight (mg) of iodine reduced in a carbon tetrachloride solution containing a given weight of iodine by dipping a unit weight, i.e., 1 g, of the pigments for a given time by the specific surface area of the pigments.

According to the knowledge gathered by the present inventors, the indoor discoloration of recorded images is due to the oxidative decomposition of dye, and when the dye is trapped onto the surface layer of a recording medium, the dye is brought into contact with air correspondingly, and particularly when the dye is trapped onto pigments having a larger specific surface area, the contact area with air is increased correspondingly and thus indoor discoloration is more liable to take place. However, the conventional pigments having a smaller specific surface area are so insufficient in adsorbability that the dye permeates deeply into the recording medium from the surface layer together with the solvent and thus the coloring of dye, that is, the density of recorded images, is lowered.

The present inventors have found that the iodine adsorbability per unit area of pigments is in good correlation to the density of jet ink-recorded images, and a sufficient recorded optical density can be obtained by forming an ink receiving layer comprising pigment particles having an iodine adsorbability of unit surface area of 1.5 $mg/m^2$ or more, even if the pigment particles have a smaller specific surface area.

The correlation of the iodine adsorbability per unit surface are is the optical density shows that the electron affinity of pigment particles is intensified with increasing iodine adsorbability per unit surface area. Since pigments have a property of easily adsorbing an acid dye or a direct dye used for the ink jet recording, the dye is trapped into the region near the surface layer of an ink receiving layer and thus it is expectable that a higher optical density can be obtained.

The pigments having the above-mentioned property include magnesium compounds, such as magnesium oxide, magnesium hydroxide, magnesium silicate, magnesium oxalate, magnesium calcium carbonate, basic magnesium carbonate and their double salts. Preferable are magnesium oxide, magnesium hydroxide, and basic magnesium carbonate, which are sparingly soluble in water.

In case of using magnesium oxide as a pigment, magnesium oxide is substantially completely converted to magnesium hydroxide during the slurry formation, and thus there is substantially no magnesium oxide on a support. However, a procedure of using magnesium oxide as a starting material, converting it to magnesium hydroxide during the slurry formation, and then applying the slurry of magnesium hydroxide to a support has the following advantages. The principal characteristic of the present invention is to use pigment particles having a higher iodine adsorbability per unit surface area. However, such pigment particles have not been formed among the well-known, conventional pigments, and sufficient optical density has not been obtained with pigments having such a small specific surface area to cause no indoor discoloration, as already explained before.

The present inventors have found that the iodine adsorbing activity of magnesium hydroxide formed by making magnesium oxide into a slurry is connected to the activity of magnesium oxide as a starting material and conditions for making the slurry. That is, the present inventors have found that it is satisfactory to make magnesium oxide having a high iodine adsorbability per unit surface area into a slurry of magnesium hydroxide having average primary particle sizes of 0.01 to 0.5 μm, preferably 0.1 to 0.5 μm upon primary coagulation and average secondary particle sizes of 1 to 10 μm, preferably 1 to 5 μm upon secondary coagulation. Likewise in case of using basic magnesium carbonate as pigments, the above-mentioned particle design is applicable.

Generally, basic magnesium carbonate can be obtained by bubbling a slurry of hydrated magnesium hydroxide with a carbon dioxide gas, thereby conducting carbonation. The present inventors have found that it is possible to obtain basic magnesium carbonate capable of producing recorded images with desirable effects i.e. a high optical density and no indoor discoloration, depending upon conditions for carbonation and a difference in the iodine absorbing activity of magnesium hydroxide.

A preferable procedure for carbonation will be described below.

In case of using magnesium oxide as a starting material, magnesium oxide is added to water of a concentration of 15 to 20% by weight, and then the mixture is stirred by a power homogenizer for about 30 minutes. After this operation, magnesium oxide is substantially completely converted to magnesium hydroxide. The thus formed magnesium hydroxide is in a coagulate form having particle sizes of 1 to 20 μm. Then, the concentration of magnesium hydroxide is lowered to 3 to 10% by weight, and then the mixture is bubbled with a carbon dioxide gas at a flow rate of 500 ml/min. or more, while keeping the temperature of the mixture at 45° to 80° C. and stirring the mixture by a power homogenizer, thereby conducting carbonation. It is enough only to monitor the progress of the carbonation reaction by X-ray diffraction and DTA. The carbonation reaction can be discontinued at any desired stage between 20% and 100% of carbonation degree. The carbonation degree can be determined from a ratio of integral intensity of peaks of the X-ray diffraction spectrum. When the carbonation is discontinued at an initial stage, for example, at a carbonation degree of about 20% to about 50%, portions of coagulates, that is, primary particles projected from the surfaces of the coagulates, undergo the carbonation reaction without disintegration of coagulates of primary particles of magnesium hydroxide. When the carbonation reaction is carried out substantially completely on the other hand, coagulates of primary particles are disintegrated and basic magnesium carbonate dispersed nearly in a state of primary particles can be obtained. Ink jet recording characteristics of the resulting basic magnesium carbonate, such as iodine adsorbability, specifc surface area (S), iodine adsorbability per unit surface area (Q), ink absorbability, etc. depend upon the iodine adsorbing activity, specific surface area, particle size, and particle size distribution of magnesium oxide as a starting material or magnesium hydroxide, which further depend upon the stage at which the carbonation reaction is discontinued. Thus, it is preferable to set the end point of carbonation reaction to a stage at which the desired characteristics can be obtained.

The pigment used in the present invention is not particularly limited so long as it has the above-mentioned specific ranges of BET specific surface area and iodine adsorbability per unit surface area. When pigments having a specific surface area of more than 120 $m^2/g$ are used, the indoor discoloration is further intensified. In case of pigments having a specific surface area of less than 30 $m^2/g$, a proportion of dye trapped in the region near the surface layer of the ink receiving layer is decreased even if the iodine adsorbability is higher, and thus the density of recorded images is a problem. In case of pigments having an iodine adsorbability per unit surface area of less than 1.5 mg/m$^2$, the density of recorded images will be decreased.

As pigments that form the ink receiving layer in the recording medium according to the present invention, the above-mentioned pigment particles can be used alone or in a combination thereof in an appropriate mixing ratio. In order to improve the ink absorbability and other recording characteristics, so far well-known inorganic pigments such as silica, alumina, aluminum silicate, calcium silicate, clay, kaolin, talc, diatomaceous earth, etc. or organic pigments such as urea resin, etc or mixtures thereof can be used together with the pigment having physical properties as mentioned above. In that case, it is preferable to use at least 60% by weight, preferably at least 80% by weight, on the basis of total pigments, of pigment particles having a BET specific surface area of 30 to 120 m$^2$/g and an iodine adsorbability per unit surface area of 1.5 mg/m$^2$ or more according to the present invention. Below 60% by weight, the indoor discoloration appears after preservation for a prolonged time.

It is desirable that the particle size of primary particles of pigments for use in the present invention is not more than 20 $\mu$m, preferably not more than 5 $\mu$m, most preferably 0.01 to 5 $\mu$m. According to the findings made by the present inventors, the smaller the particle sizes of pigment particles, the better the light resistance of recorded images. When the particle sizes of primary particles are below 0.01 $\mu$m, the density of recorded images will be lowered.

The support for use in the present invention is preferably a paper sheet having an ink absorbability, but the present invention is not particularly limited thereto. For example, the support may be a polymer film usually used. In that case, it is necessary to use pigments having such an absorbability as to completely absorb the ink in the ink receiving layer or make the thickness of the ink receiving layer larger or conduct a combination of these steps.

The present invention will be described in detail below, referring to a preferred embodiment wherein the support is a paper sheet having a liquid absorbability.

The ink receiving layer in the recording medium according to the present invention comprises the above-mentioned pigment particles, a binder and other additives.

The binder for use in the present invention includes, for example, so far well-known water-soluble polymers such as polyvinyl alcohol, starch, oxidized starch, cationized starch, casein, carboxymethylcellulose, gelatin, hydroxycellulose, acrylic resin, etc. and water-dispersion type polymers of SBR latex, polyvinyl acetate emulsion, etc., which are used alone or in combination of at least two thereof. An appropriate mixing ratio of the pigments to the binder (P/B) according to the present invention is 10/1 to $\frac{1}{4}$, preferably 6/1 to 1/1 by weight. When the binder is in a ratio of more than $\frac{1}{4}$, the ink absorbability of the ink receiving layer is lowered, whereas when the pigment is in a ratio of more than 10/1, peeling of pigment particles takes place.

The present recording medium can be prepared by applying a coating solution containing the above-mentioned components to the surface of a support by a roll coater method, a blade coater method, an air knife coater method, a gate roll coater method, a size press method, etc. Or, after coating of an aqueous coating material comprising pigments and a binder to the surface of a support, the applied coating is dried by a so far well-known drying method, such as by a hot air drying oven, a hot drum, etc., whereby the present recording medium can be obtained.

In order to flatten the surface of the ink receiving layer or increase the surface strength of the ink receiving layer, a supercalender can be used in the process for preparing the recording medium.

In the present invention, the ink receiving layer can further contain such additives as a dye-fixing agent (a water-withstanding agent), a fluorescent whitening agent, a surfactant, a defoaming agent, a pH-adjusting agent, an antifungal agent, an ultraviolet-absorbing agent, an antioxidant, a dispersant, etc. The additives can be selected, as desired, from the so far well-known compounds in accordance with the desired object.

An amount of pigment to be applied as an ink receiving layer is 0.2 to 20 g/m$^2$, preferably 0.2 to 8 g/m$^2$, on the basis of a total of pigments. Below 0.2 g/m$^2$, no remarkable effect is obtained on the coloring property of the dye, when compared with the case of using no ink receiving layer, that is, no pigment-containing layer, whereas above 20 g/m$^2$, or when the maximum thickness of the ink receiving layer exceeds 25 $\mu$m, a problem of paper dust generation appears. The maximum thickness of the ink receiving layer referred to herein is a maximum thickness in the depth direction of the ink receiving layer at the cross-section of a recording medium, and the amount of pigments applied referred to herein is an amount obtained as a value by subtracting the amount of ash content of a paper sheet or a support from total ash content of a recording medium according to the JIS-P-8128 procedure.

In the present invention, a sheet paper having a low Stöckigt sizing degree is used as a support, and it is preferable to adjust the Stöckigt sizing degree as a recording medium to a range of 0 to 15 seconds, preferably 0 to 10 seconds, by controlling the coating amount of the ink receiving layer, because of a distinguished ink absorbability.

When the present recording medium having the above-mentioned structure is subjected to recording with a plurality of aqueous inks of Yellow (Y), Magenta (M), Cyan (C), Black (Bk), etc., the resulting recorded images have a good preservability without any indoor discoloration.

Any well-known ink can be used in the present invention. For example, water-soluble dyes, typified by a direct dye, an acid dye, a basic dye, a reactive dye and an edible dye, etc. can be used as recording agents. Any recording agent can be used without any particular limitation, so long as it can be used for the ordinary ink jet recording.

Such a water-soluble dye is used generally in a proportion of about 0.1 to about 20% by weight in the conventional ink, and this proportion is likewise applicable to the present invention.

The solvent for use in the aqueous ink in the present invention is water or a mixture of water with a water-soluble organic solvent. Particularly preferable is a mixture of water with a water-soluble organic solvent, where polyhydric alcohols having an effect upon the prevention of ink drying are included as the water-soluble organic solvent. It is preferable not to use ordinary water containing various ions, but deionized water as the water.

Concentration of the water-soluble organic solvent in the ink, on the basis of total weight of ink, is 0 to 95% by weight, preferably 2 to 80% by weight, more preferably 5 to 50% by weight.

The ink for use in the present invention can further contain a surfactant, a viscosity controlling agent, a surface tension-controlling agent, etc., if required, in addition to the above-mentioned components.

As a process for recording by imparting the above-mentioned ink to the above-mentioned recording medium according to the present invention, any recording process can be used. Preferable is an ink jet recording process, which may be based on any system, so long as it is a system capable of effectively ejecting the ink from a nozzle and imparting the ink to a recording medium as a target body.

Particularly, an ink jet system capable of subjecting an ink to an abrupt volumetric expansion under the action of heat energy and ejecting the ink from a nozzle by the force of a action caused by a state change according to the process disclosed in Japanese Patent Laid-Open No. 54-59936 can be effectively used.

The present invention will be described in further detail below, referring to Examples and Comparative Examples.

EXAMPLE 1

A paper sheet having a Stöckigt sizing degree of 5 seconds, a basis weight of 66 g/m$^2$, and a calcium carbonate content of 9.0% by weight in terms of ash content according to JIS-P-8128 was used and a coating material having the following composition was used.

| | |
|---|---|
| Water | 200 parts by weight |
| Polyvinyl alcohol (PVA-105, made by Kurare K. K., Japan) | 4 parts by weight |
| Polyvinyl alcohol (PVA-117, made by Kurare K. K., Japan) | 2 parts by weight |
| Magnesium oxide (ultrafine magnesia made by Ube Kagaku K. K., primary particle sizes: 0.02 μm; apparent specific gravity: 0.32 g/m$^3$) | 30 parts by weight |
| Sodium hexametaphosphate | 0.6 part by weight |

The coating material was prepared by mixing 150 parts by weight of water with 30 parts by weight of magnesium oxide and 0.6 part by weight of sodium hexametaphosphate, and the mixture was dispersed in a sand mill with glass beads of 1 mm in diameter, at 1,500 rpm for 60 minutes. Then, the dispersion was taken out of the sand mill and admixed with a solution containing 4 parts by weight of PVA-105 and 2 parts by weight of PVA-117 in 50 parts by weight of water, and the mixture was stirred, whereby the coating material was obtained.

The thus-obtained coating material was applied to the paper sheet by a bar coater so that the amount of the material thus applied may be 5 g/m$^2$ after drying at 110° C. for 5 minutes, whereby a recording medium 1 was obtained. The magnesium hydroxide formed from the magnesium oxide used had a BET specific surface area (S) of 58 m$^2$/g and an iodine absorbability (Q) per unit surface area of 1.85 mg/m$^2$, determined by an oxidation-reduction titration method using sodium thiosulfate.

The ink jet recording adaptability of the thus obtained recording medium was evaluated by ink jet recording with inks of the following composition by an ink jet printer with an ink jet head using four inks of Y, M, C and Bk through 128 nozzles at a density of 16 nozzles in a distance of 1 mm.

| Ink Composition | |
|---|---|
| Dye | 5 parts by weight |
| Diethylene glycol | 20 parts by weight |
| Water | 78 parts by weight |
| Dyes used for inks (I)-(IV): | |
| Y: C.I. Direct Yellow 86 | (ink I) |
| M: C.I. Acid Red 35 | (ink II) |
| C: C.I. Direct Blue 199 | (ink III) |
| Bk: C.I. Food Black 2 | (ink IV) |

The evaluation was carried out with respect to the following two items.

(1) Optical density

Density of Black (Bk) of print paper sheets solid-printed by the ink jet printer was evaluated by a MacBeth reflection densitometer RD-918.

(2) Indoor preservability

Printed paper sheets obtained in (1) were pasted on the office wall and left for 3 months and 6 months as they were. A color difference ($\Delta E^*$) of chromaticity between the images right after solid-printing of paper sheets with Black (Bk) (before leaving as they were) and that after leaving as they were was determined to evaluate the indoor preservability. Results are shown in Table 1.

EXAMPLE 2

A recording medium 2 was prepared in the same manner as in Example 1 except that the amount of the magnesium oxide used in Example 1 was reduced to 24 parts by weight, but 6 parts by weight of alumina (AKP-G, γ-alumina made by Sumitomo Kagaku Kogyo K.K., primary particle size: 0.05 μm; BET specific surface area 136 m$^2$/g ) was used as a pigment. The ink jet recording characteristics of the thus-prepared recording medium 2 were substantially the same as those of the recording medium 1 of Example 1, as shown in Table 1, but the ink absorbability was improved.

EXAMPLES 3 and 4

Basic magnesium carbonate was synthesized from magnesium oxide MTK-30 made by Iwatani Kagaku Kogyo K.K. (average particle size: 0.19 μm; BET specific surface area: 160 m$^2$/g ) as a starting material in place of the magnesium oxide of Example 1 by bubbling its hydrate with a carbon dioxide gas. That is, 20 parts by weight of magnesium oxide was dispersed in 100 parts by weight of water and the mixture was stirred by a power homogenizer for 30 minutes. During the stirring, magnesium oxide (MgO) was converted substantially completely to magnesium hydroxide $\{Mg(OH)_2\}$. Then, 100 parts by weight of water was further added to the mixture, and the mixture was subjected to carbonation with continued stirring while bubbling the mixture with a carbon dioxide gas at a flow rate of 500 ml/min. The carbonation reaction was carried out for 3 hours while keeping the reaction temperature at 50° C. It was found as a result of X-ray diffraction and DTA measurement that magnesium hydroxide was converted completely to basic magnesium carbonate.

The thus-obtained pigment had S and Q values as follows:

$S=35\ m^2/g$ and $Q=2.43\ mg/m^2$.

A coating material was prepared from the thus-prepared pigment in the same composition as in Example 1 except that only the pigment of Example 1 was replaced with the thus-prepared pigment, and a recording medium 3 was obtained by applying the thus-prepared coating material to the same paper sheet as used in Example 1 so that the pigment can be in an amount of 3 $g/m^2$ (dry basis).

Another coating material was prepared from the thus-prepared pigment in the same manner as above except that the amount of the basic magnesium carbonate was reduced from 30 parts by weight to 20 parts by weight and 10 parts by weight of the same magnesium hydroxide as used in Example 1 was used instead, and another recording medium 4 was also prepared by applying the thus-obtained coating material to the same paper sheet as used in Example 1 so that the pigment can be in an amount of 3 $g/m^2$ (dry basis). Results of evaluating the ink jet recording adaptability of recording media 3 and 4 are shown in Table 1. The recording medium 4 had a much higher optical density than that of the recording medium 3. The recording medium 4 had a better ink absorbability than that of the recording medium 1.

EXAMPLE 5

A coating material was prepared in the same manner as in Example 1, except as a pigment, a mixture of 20 parts by weight of basic magnesium carbonate ($S=35\ g/m^2$, $Q=2.43\ mg/m^2$), prepared in the same manner as in Example 3. and 10 parts by weight of alumina (γ-alumina, AKP-G produced by Sumitomo Kagaku K.K., primary particle size: 0.05 μm, BET specific surface area: 136 $m^2/g$ ) was used. The coating material was applied to the synthesized paper (Upo, a product of Ohji Papar Co., Ltd.) by a bar coater so that the amount of the material thus applied was 20 $g/m^2$ after drying, whereby a recording medium 5 was obtained. The evaluation was carried out according to Examples 1 to 4. The results are shown in Table 1.

COMPARATIVE EXAMPLES 1 TO 5

Recording media were prepared each from pigments having the S and Q values shown in Table 2 in the same manner as in Example 1 by application of the respective coating materials thus obtained to the same paper sheets as used in Example 1 so that the respective pigments were in an amount of 5 $g/m^2$ (dry basis). The ink jet recording characteristics of the thus-prepared recording media were evaluated in the same manner as in Example 1. The results are shown in Table 3. The thus-prepared recording media failed to satisfy both of the optical density and indoor discoloration resistance at the same time.

TABLE 1

Optical density and indoor preservability of Examples

| Example | Optical density | After 3 month preservation $\Delta E^*_{Bk}$ | After 6 month preservation $\Delta E^*_{Bk}$ |
|---|---|---|---|
| 1 | 1.45 | 2.4 | 3.8 |
| 2 | 1.50 | 3.2 | 5.2 |
| 3 | 1.40 | 2.0 | 2.9 |
| 4 | 1.48 | 2.3 | 3.5 |

TABLE 1-continued

Optical density and indoor preservability of Examples

| Example | Optical density | After 3 month preservation $\Delta E^*_{Bk}$ | After 6 month preservation $\Delta E^*_{Bk}$ |
|---|---|---|---|
| 5 | 1.55 | 2.5 | 3.6 |

Note: Color difference $\Delta E^*_{Bk} \approx$ about 10 is a standard value for visual observation of color change.

TABLE 2

Physical properties of pigments used in Comparative Examples 1 to 5
S: BET specific surface area ($m^2/g$)
Q: iodine adsorbability ($mg/m^2$)

| Comp. Ex. | Pigment | S | Q |
|---|---|---|---|
| * 1 | Magnesium oxide, MH-30 (made by Iwatani Kagaku) | 45.0 | 1.20 |
| 2 | Basic magnesium carbonate (made by Asahi Glass) | 32.0 | 1.15 |
| 3 | γ-Alumina μA-5600 (made by Showa Denko) | 70.8 | 0.79 |
| 4 | Silica E-150J (made by Nihon Silica) | 90.0 | 0.39 |
| 5 | Silica Tokusil CM (made by Tokuyama Soda) | 75.0 | 0.20 |

*: Starting material is magnesium oxide, which exists as magnesium hydroxide on the coating layer. Thus, the S and Q values are values after conversion to magnesium hydroxide.

TABLE 3

Optical density and indoor stability of Comparative Examples 1 to 5

| Comp. Ex. | Optical Density | After 3 month preservation $\Delta E^*_{Bk}$ | After 6 month preservation $\Delta E^*_{Bk}$ |
|---|---|---|---|
| 1 | 1.10 | 1.9 | 4.0 |
| 2 | 1.15 | 3.0 | 5.0 |
| 3 | 1.56 | 10.0 | 26.0 |
| 4 | 1.40 | 15.0 | 34.0 |
| 5 | 1.30 | 11.3 | 29.4 |

The present recording medium is particularly suitable for ink jet recording with an ink containing a water-soluble dye and has the following two typical effects.

(1) There is no problem of image preservation peculiar to coated paper. That is, there is no discoloration problem after the color images formed on the present recording medium by an ink jet recording system using a multi-color ink are preserved on an office wall, etc. kept free from exposure to direct sun light even for several months.

(2) In addition to the above-mentioned effect (1), the dots form nearly true circles with a high density, and the dots are not excessively blurred and are without feathering. Thus, clear images can be formed with a high resolution.

What is claimed is:

1. A recording medium, which comprises a support and an ink receiving layer containing pigments provided on the support, one of said pigments having a BET specific surface area of 30 to 120 $m^2/g$ and an iodine adsorbability per unit surface area of 1.5 $mg/m^2$ or more and being the main pigment component, wherein the total amount of pigments in the ink-receiving layer is at least 0.2 $g/m^2$.

2. The recording medium according to claim 1, wherein said main pigment component is contained in an amount of at least 60% by weight on the basis of total pigments of said ink receiving layer.

3. The recording medium according to claim 1, wherein said main pigment component is in an amount of at least 80% by weight on the basis of total pigments of said ink receiving layer.

4. The recording medium according to claim 1, wherein said main pigment component is a magnesium compound.

5. The recording medium according to claim 4, wherein said magnesium compound is at least one selected from the group consisting of magnesium oxide, magnesium hydroxide, magnesium silicate, magnesium oxalate, magnesium calcium carbonate, basic magnesium carbonate and double salts thereof.

6. The recording medium according to claim 1, wherein a primary particle size of said main pigment component is in a range of 0.01 to 5 μm.

7. The recording medium according to claim 1, wherein the total amount of pigments in said ink receiving layer is in a range of 0.2 to 20 g/m$^2$.

8. A recording medium, which comprises a liquid-adsorbable sheet and an ink receiving layer containing pigments provided on the surface of said liquid-adsorbable sheet, one of said pigments having a BET specific surface area of 30 to 120 m$^2$/g and an iodine adsorbability per unit surface area of 1.5 mg/m$^2$ or more and being the main pigment component, wherein the total amount of pigments in the ink-receiving layer is at least 0.2 g/m$^2$, and wherein the Stöckigt sizing degree throughout said recording medium is in a range of 0 to 15 seconds.

9. The recording medium according to claim 8, wherein said main pigment component is in an amount of at least 60% by weight on the basis of total pigments of said ink receiving layer.

10. The recording medium according to claim 8, wherein said main pigment component is in a range of at least 80% by weight on the basis of total pigments of said ink receiving layer.

11. The recording medium according to claim 8, wherein said Stöckigt sizing degree of said recording medium is in a range of 0 to 10 seconds.

12. The recording medium according to claim 8, wherein said main pigment component is a magnesium compound.

13. The recording medium according to claim 12, wherein said magnesium compound is at least one selected from the group consisting of magnesium oxide, magnesium hydroxide, magnesium silicate, magnesium oxalate, magnesium calcium carbonate, basic magnesium carbonate and double salts thereof.

14. The recording medium according to claim 8, wherein a primary particle size of said main pigment component is in a range of 0.01 to 5 μm.

15. The recording medium according to claim 8, wherein the total amount of pigments in said ink receiving layer is in a range of 0.2 to 20 g/m$^2$.

16. A recording medium, which comprises a support and an ink receiving layer containing pigments, said pigments comprising a pigment (A) having a BET specific surface area of 30 to 120 m$^2$/g and an iodine adsorbability per unit surface area of 1.5 mg/m$^2$ or more as the main pigment component, and another pigment (B), wherein the total amount of pigments in the ink-receiving layer is at least 0.2 g/m$^2$.

17. The recording medium according to claim 16, wherein the pigment (A) is in an amount of at least 60% by weight on the basis of total pigments of said ink receiving layer.

18. The recording medium according to claim 16, wherein said pigment (A) is in an amount of at least 80% by weight on the basis of total pigments of said ink receiving layer.

19. The recording medium according to claim 16, wherein said pigment (A) is a magnesium compound.

20. The recording medium according to claim 19, wherein said magnesium compound is at least one selected from the group consisting of magnesium oxide, magnesium hydroxide, magnesium silicate, magnesium oxalate, magnesium calcium carbonate, basic magnesium carbonate and double salts thereof.

21. The recording medium according to claim 16, wherein a primary particle size of said pigment (A) is in a range of 0.01 to 5 μm.

22. The recording medium according to claim 16, wherein said pigment (B) is at least one selected from silica, alumina, aluminum silicate, calcium silicate, clay, talc, kaolin, diatomaceous earth and urea resin.

23. The recording medium according to claim 16, wherein the total amount of pigments in said ink receiving layer is in a range of 0.2 to 20 g/m$^2$.

24. A recording medium, which comprises a liquid-adsorbable sheet and an ink receiving layer containing pigments provided on the surface of the liquid-adsorbable sheet, said pigments comprising a pigment (A) having a BET specific surface area of 30 to 120 m$^2$/g and an iodine adsorbability per unit surface area of 1.5 mg/m$^2$ or more as the main pigment component, and another pigment (B), wherein the total amount of pigments in the ink-receiving layer is at least 0.2 g/m$^2$, and wherein the Stöckigt sizing degree throughout said recording medium is in a range of 0 to 15 seconds.

25. The recording medium according to claim 24, wherein said pigment (A) is in an amount of at least 60% by weight on the basis of total pigments of said ink receiving layer.

26. The recording medium according to claim 24, wherein said pigments (A) is in an amount of at least 80% by weight on the basis of total pigments of said ink receiving layer.

27. The recording medium according to claim 24, wherein said pigment (A) is a magnesium compound.

28. The recording medium according to claim 27, wherein said magnesium compound is at least one selected from the group consisting of magnesium oxide, magnesium hydroxide, magnesium silicate, magnesium oxalate, magnesium calcium carbonate, basic magnesium carbonate and double salts thereof.

29. The recording medium according to claim 24, wherein a primary particle size of said pigment (A) is in a range of 0.01 to 5 μm.

30. The recording medium according to claim 24, wherein said pigment (B) is at least one selected from silica, alumina, aluminum silicate, calcium silicate, clay, talc, kaolin, diatomaceous earth, and urea resin.

31. The recording medium according to claim 24, wherein the total amount of pigments in said ink receiving layer is in a range of 0.2 to 20 g/m$^2$.

32. A process for recording, which comprises the step of imparting liquid droplets of a recording solution containing a water-soluble dye to a recording medium, the recording medium having an ink receiving layer containing pigments, one of said pigments having a BET specific surface area of 30 to 120 m$^2$/g and an iodine adsorbability per unit surface area of 1.5 mg/m$^2$ or more and being the main pigment component, wherein the total amount of pigments in the ink-receiving layer is at least 0.2 g/m$^2$.

33. The process according to claim 32, wherein said water-soluble dye is a direct dye or an acid dye.

34. The process according to claim 32, wherein said recording is carried out by ink jet recording.

35. The process according to claim 32, wherein said main pigment component is in a range of at least 60% by weight on the basis of total pigments of said ink receiving layer.

36. The process according to claim 32, wherein said main pigment is in a range of at least 80% by weight on the basis of total pigments of said ink receiving layer.

37. The process according to claim 32, wherein the main pigment is a magnesium compound.

38. The recording medium according to claim 37, wherein said magnesium compound is at least one selected from the group consisting of magnesium oxide, magnesium hydroxide, magnesium silicate, magnesium oxalate, magnesium calcium carbonate, basic magnesium carbonate and double salts thereof.

39. The process according to claim 32, wherein the total amount of pigments in said ink receiving layer is in a range of 0.2 to 20 g/m$^2$.

* * * * *

UNITED STATES PATENT AND TRADEMARK OFFICE

CERTIFICATE OF CORRECTION

PATENT NO. : 5,081,470

DATED : January 14, 1992

INVENTOR(S) : Yutaka Kurabayashi, et al.

It is certified that error appears in the above-identified patent and that said Letters Patent is hereby corrected as shown below:

COLUMN 3:

Line 28, "are" should read --area--.

COLUMN 9:

Line 36, "Example 3." should read --Example 3,--.

Signed and Sealed this

Twenty-third Day of June, 1992

*Attest:*

DOUGLAS B. COMER

*Attesting Officer*

*Acting Commissioner of Patents and Trademarks*